United States Patent [19]

Del Bon

[11] 3,937,582

[45] Feb. 10, 1976

[54] FOUNTAIN TOOTHBRUSH

[75] Inventor: Franco Del Bon, Zofingen, Switzerland

[73] Assignee: Trisa Burstenfabrik AG

[22] Filed: Mar. 21, 1974

[21] Appl. No.: 453,391

[30] Foreign Application Priority Data

Mar. 21, 1973 Switzerland ..... 4004/73
Jan. 19, 1974 Switzerland ..... 875/74

[52] U.S. Cl. ..... 401/134; 401/176
[51] Int. Cl. ..... A46b 11/00
[58] Field of Search ..... 401/176, 149, 150, 286, 401/177, 178, 132–135; 132/84

[56] References Cited

UNITED STATES PATENTS

| | | | |
|---|---|---|---|
| 1,809,330 | 6/1931 | Dorrance et al. | 401/176 X |
| 3,061,868 | 11/1962 | Miller | 401/135 |
| 3,217,720 | 11/1965 | Cyzer | 401/135 X |
| 3,227,165 | 1/1966 | Costanza | 401/286 X |

FOREIGN PATENTS OR APPLICATIONS

| | | | |
|---|---|---|---|
| 832,415 | 7/1938 | France | 401/134 |
| 729,378 | 12/1966 | Italy | 401/176 |

*Primary Examiner*—Lawrence Charles
*Attorney, Agent, or Firm*—Heinrich W. Herzfeld; Gilbert L. Wells

[57] ABSTRACT

A fountain toothbrush is described which comprises a bristle carrier, a set of bristles on the carrier near one end thereof, a rigid handle connected to the bristle carrier at an end of the latter remote from the bristles, and a reservoir for liquid or pasty dentifrice in the handle, wherein the bristle carrier has a duct therethrough leading from the bristle carrier to an outlet near or between the bristles; furthermore piston means mounted on the bristle carrier, and outlet means associated with the reservoir, the aforesaid piston being sealingly guided in the outlet means and adapted for displacement in the outlet means toward and away from the reservoir, whereby dentifrice is caused to flow from the reservoir through the duct towards the bristles by a short displacement of the piston in the outlet means toward the reservoir.

9 Claims, 5 Drawing Figures

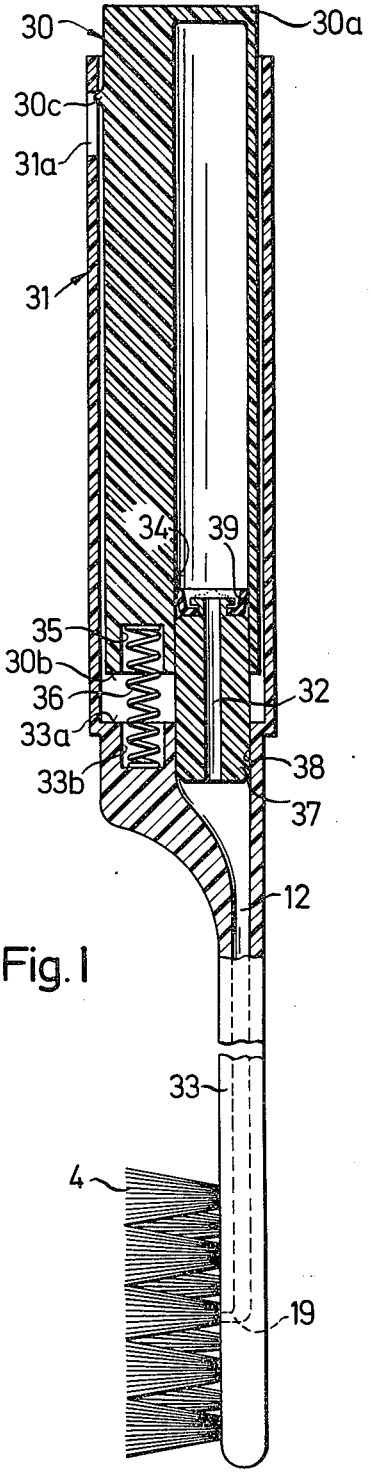
Fig. 1
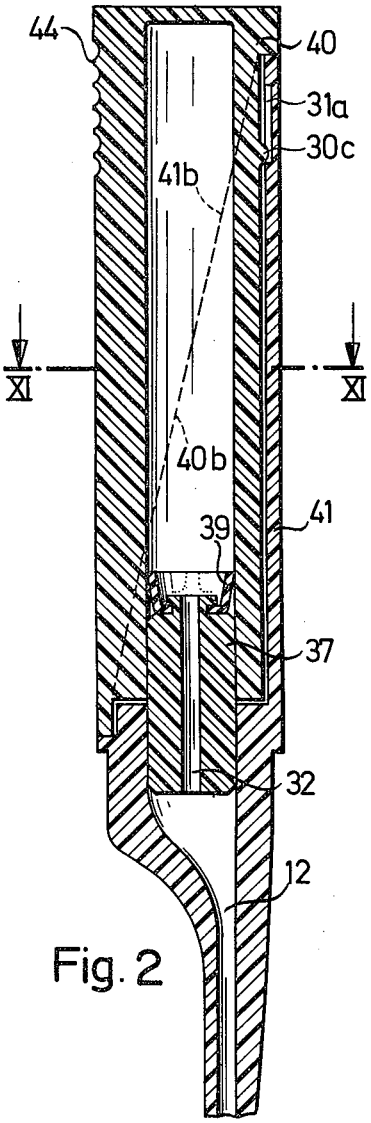
Fig. 2
Fig. 3
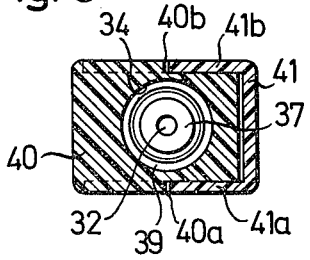

FOUNTAIN TOOTHBRUSH

BACKGROUND OF THE INVENTION

This invention relates to a fountain toothbrush having a bristle carrier, a reservoir for liquid or pasty dentifrice contained in a handle connected to the bristle carrier, a duct leading from the reservoir through the bristle carrier to a set of bristles on the latter and being adapted for the passage of dentifrice therethrough, and actuating means for causing dentifrice to flow from said reservoir to the bristles on the bristle carrier.

Fountain toothbrushes of this type have been described, for instance, in British patent specification No. 267,528 and German Offenlegungsschrift No. 2,152,512. However, these known fountain toothbrushes always require the presence of a manually operated air inlet valve associated with the dentifrice reservoir and arranged near or at the end of the handle away from the aforesaid duct. This end will be referred to hereinafter as the "rear end" of the handle or of the reservoir or of the toothbrush.

OBJECT AND SUMMARY OF THE INVENTION

It is an object of the present invention to provide a fountain toothbrush of the initially described type which makes possible an unobjectionable actuation of the toothbrush without unintentional loss of dentifrice from the reservoir while the wall of the handle, apart from the duct connected to the reservoir is free from any openings such as would be required for an air inlet valve as it is found in the known toothbrushes of this type.

It is more particularly an object of the invention to provide a fountain toothbrush in which the reservoir wall which may be advantageously constituted by the wall of the handle itself has a single opening, preferably at one end thereof which opening opens into the duct through the bristle carrier. This wall of the reservoir is therefore uninterrupted and perfectly seals off the dentifrice from the outside except through the aforesaid opening.

It is a further object of the invention to provide the handle with a rigid wall which does not yield to squeezing manual pressure contrary to the flexible wall or wall portion of the handle that is found in a certain type of known fountain toothbrushes such as that described in German Offenlegungsschrift No. 1,904,801.

These objects are attained according to the invention by a fountain toothbrush of the type described initially hereinbefore which comprises, as essential feature, a bristle carrier which is provided, at the end thereof away from the bristles thereon, with a piston which is guided sealingly in the adjacent end of the toothbrush handle, and wherein dentifrice is caused to flow from the reservoir to the bristles on the bristle carrier by a simple inwardly directed movement of the piston into the handle surrounding the latter.

It has been found that, surprisingly, a relative short stroke of the piston into the handle is sufficient to convey a small portion of a dentifrice of satisfactory liquidity onto the bristles, even when only a minor portion of the internal volume of the reservoir remains filled with the dentifrice. When, however, dispensing toothpastes of conventional consistency, it is necessary to plunge the piston more or less deeply into the interior of the handle, depending on the amount of dentifrice present in the latter.

Fountain toothbrushes which have a movable piston in the dentifrice reservoir have been described, for instance, in U.S. Pat. Nos. 2,214,144, 2,305,158 and 3,039,776 as well as in French Pat. No. 769,734. However, in all these devices, the piston must be actuated from the rear end of the reservoir by means of an actuating means passing through the end wall of the reservoir.

Due to the fact that most of the time a fountain toothbrush will be carried by the user clipped in a pocket, with the rear end of the toothbrush pointing downwardly, sealing means are required which must be particularly safe and are accordingly complicated and costly.

The problems of sealing such actuating means in the reservoir wall are completely avoided in the fountain toothbrush according to the invention while, at the same time, the expense for separate actuating means is eliminated.

In the embodiments of the fountain toothbrush according to the invention in which the wall of the handle constitutes at the same time the wall of the reservoir, this rigid wall need thus contain only a single opening to which the bristle carrier is connected and through which dentifrice can be filled as well as discharged.

Preferably, the fountain toothbrush according to the invention is provided with arresting means preventing a complete withdrawal of the piston out of the handle during normal use of the toothbrush. This arresting means can be actuated to release the piston from the reservoir when the latter is to be refilled with dentifrice. It is also possible to place an exchangeable cartridge filled with dentifrice into the hollow interior of the handle, and to remove a closure of the cartridge at the end thereof toward the piston and bristle carrier before or during introduction of the piston into the hollow interior of the cartridge.

In the embodiment of the fountain toothbrush according to the invention comprising an exchangeable cartridge, the body of the bristle carrier at the end thereof bearing the piston is preferably lengthened to comprise a sleeve portion serving as the handle and being open at the rear end. In this case the cartridge which is closed at its rear end is inserted in the sleeve portion of the bristle carrier and displaceably guided therein. In this case the piston is preferably provided with a piercing nose surrounding the dentifrice duct through the piston and serving to penetrate through a sealing membrane or the like means covering the outlet opening of the cartridge before use.

When a liquid dentifrice of low viscosity is used, a short stroke of the piston into the reservoir as already mentioned is all that is needed to bring a sufficient amount of liquid onto the bristles, even if the filling height of the reservoir is low, when the toothbrush is held with the bristles pointing downward.

It is also preferred that at least part of the duct leading through the bristle carrier be formed as a capillary tube, thus preventing the liquid dentifrice to pass through to the bristles while the piston is in its most withdrawn end position relative to the front end of the reservoir facing toward the bristle carrier.

When using a liquid dentifrice of conventional viscosity, the capillary tube preferably has a diameter of about 0.5 to 1.5 mm, whereas the remaining portion of the duct can have a diameter above 1.5 mm and preferably one of about 2 mm. Very satisfactory results were obtained with a duct 2 mm in diameter, over most of its length whereof only the opening towards the set of bristles showed a capillary width of 0.8 mm and Weleda mouth-water or Chlorodont mouth-water of a commercially available composition were used.

Cap means for sealing can be provided especially for use under extreme conditions, e.g. when the toothbrush is taken along in aeroplanes flying through the stratosphere, or when using dentifrice liable to be decomposed by air. Such cap means close the mouth of the duct from the piston into the reservoir while the piston is in neutral position. Elastic sealing means are preferred for this purpose which may be formed as a projection of the inner wall of the handle surrounding the reservoir, whereby said means preferably lock the duct leading out of the side of a projection of the piston into the reservoir, while the piston is in the above-mentioned maximally withdrawn end position. Abutment means determining the inward displacement of the piston relative to the reservoir in the handle are preferably formed by a projection on the piston or on the bristle carrier carrying the same, which projection protrudes through a cut-out in the adjacent wall of the handle. These abutment means can be manipulated by a finger, i.e., the index finger, of the same hand that holds the handle. In this case, an inward displacement of the piston from the above-described end-position by only 2 mm into the reservoir is sufficient, when using liquid dentifrice of conventional viscosity.

The invention will be better understood, and further objects and advantages will become apparent from the ensuing detailed specification of preferred but merely exemplary embodiments taken in conjunction with the drawings.

BRIEF DESCRIPTION OF THE DRAWINGS

FIG. 1 shows in axial section a third preferred embodiment of the fountain toothbrush according to the invention wherein the bristle carrier comprises a sleeve portion serving as a handle which houses a dentifrice reservoir in the form of a cartridge;

FIG. 2 shows in axial section a fourth embodiment of the fountain toothbrush wherein the bristle carrier comprises a tapered half-sleeve portion which, together with a portion of the cartridge wall, serves as the handle;

FIG. 3 shows a cross-sectional view through the embodiment of FIG. 10 taken along line XI—XI;

DETAILED DESCRIPTION OF THE EMBODIMENTS

Figure 4:
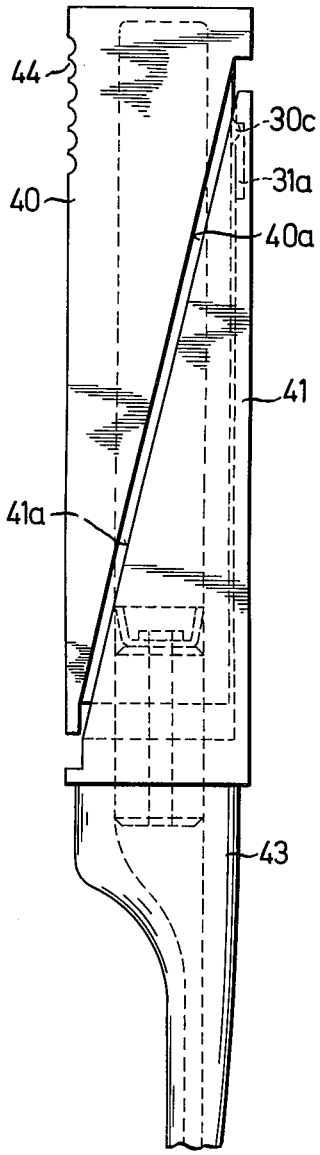
FIG. 4 shows a lateral view of the embodiment shown in FIGS. 2 and 3, with the piston in maximally withdrawn end position, the bristle-carrying portion of the bristle carrier being omitted.

In the preferred embodiment of the fountain toothbrush shown in FIG. 1, a cartridge 30 serving as a dentifrice reservoir is inserted in a sleeve portion 31 of bristle carrier 33 serving as the handle, and protrudes with its rear end at 30*a* from the open end of sleeve portion 31, whereby it can be displaced inwardly into the handle which, in the embodiment of FIG. 1, is an integral part of the bristle carrier 33. The cartridge 30 has a cylindrical discharge bore 34 into which the piston 32 which is firmly embedded in a recess 38 of the bristle carrier 33 extends, engaging the wall of recess 38 sealingly by means of an annular lip seal 39. The piston 37 has an optionally capillary axial duct 32 therethrough. The duct 32 opens in the face of piston 37 directed toward the bristles 4, borne by the bristle carrier 33, into the duct 12 which leads from the recess 38 to a lateral orifice 19 located between the bristles 4 near the opposite end of carrier 33.

Manual pressure on the rear end 30*a* of the cartridge 30 moves the latter a short way into the sleeve handle 31, maximally until the frontal face 30*b* of cartridge 30 abuts against a stop face 33*a* constituted by the internal transverse end wall of the sleeve portion 31 of bristle carrier 33. When the toothbrush is held with the bristles downwards and cartridge 30 is actuated as just described, a small amount of liquid dentifrice from the reservoir 30 is urged through the ducts 32 and 12 to the orifice 19 and flows onto the bristles 4. Since it would be difficult to return the reservoir 30, by pulling it with two fingers, to its initial position as shown in FIG. 1, in which position no dentifrice is dispensed, a small return spring 36 is housed with its one end in a recess 35 in the frontal face 30*b* of cartridge 30, and with its other end in a recess 33*b* provided in alignment with recess 35 in the stop 33*a* of the bristle carrier 33. The return motion of the reservoir 30 is limited and detachment of the reservoir 30 from the sleeve handle 31 is prevented by a catch comprising a peg 30*c* on the outer wall of cartridge 30 in snap engagement with a slot or axial groove 31a in the sleeve handle 31 (see also FIG. 13, which shows a bayonet catch at an angle of 90° to the one in FIG. 1 which requires, however, a circular cross section of cartridge and sleeve).

By providing a slot 31*a* of adequate length, the stroke of the cartridge 30 relative to the sleeve handle 31 can be limited so that abutting of the frontal face 30*b* of cartridge 30 onto the stop face 33*a* of the bristle carrier 33 is made unnecessary and the return spring 36 is less strongly compressed.

In the embodiment of the fountain toothbrush shown in FIGS. 2 to 4 the arrangement of all operating parts is similar to that shown in FIG. 1, but the reservoir part 40 and the handle part 41 must be designed as of a rectangular cross-section, which is also the preferred cross-sectional configuration in the embodiment shown in FIG. 1. The handle part 41 has sloped side walls 41*a* and 41*b*, of which the wall 41*a* lying behind the reservoir part 40 in FIG. 2 has been indicated by a dashed line, while the reservoir part 40 has corresponding sloped side wall shoulders or lasts 40*a* and 40*b*, which are preferably devised as follows. While, in the non-dispensing position, a small distance remains between the slanted sidewall edges of both parts, as shown in FIG. 4, the slanted shoulders 40*a* and 40*b* of handle part 40 abut against the sloped side wall edges 41*a* and 41*b*, respectively, of the handle part 41 when the reservoir 40 is displaced by the maximal length of its inward travel into the handle part 41, from the outward end position as shown in FIG. 4 to the inward end position shown in FIGS. 2 and 3.

Similar to the embodiment shown in FIG. 1, the embodiment shown in FIGS. 2 and 4 comprises a handle part 41 being integral with the bristle carrier 43. In FIGS. 2 and 4 no return spring has been shown, merely for the sake of clarity, but it can naturally be provided in exactly the same manner as in the embodiment shown in FIG. 1.

Figure 5:
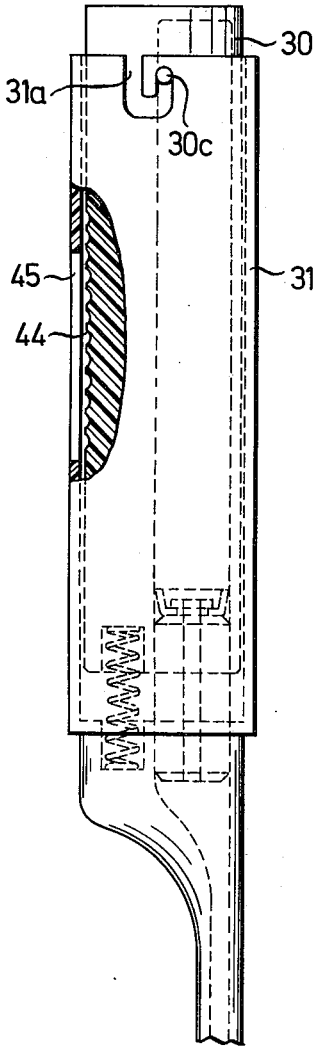
FIG. 5 shows in lateral view another embodiment of the handle and reservoir wall being in bayonet engagement.

Finally, the reservoir cartridge can be provided in a suitable portion of its outside wall with grooves 44, for instance towards the rear end of the cartridge 40 as shown in FIG. 4 or towards the front end of the cartridge 30 as shown in FIG. 5. In the embodiment shown in FIG. 5, the cartridge 30 is housed in the same kind of sleeve portion serving as a handle as is the case in the embodiment of FIG. 1, and a window 45 is provided in the handle wall through which the grooved section 44 of the cartridge wall can be reached with a finger whereby, when the toothbrush is held in the hollow of the hand with the bristle carrier projecting past the little finger out of the user's hand, the cartridge 30 can be easily displaced, e.g. by the thumb of the same hand.

As material for the main parts of the fountain toothbrush according to the invention, conventional materials such as thermo plastic resin material or metal can be used. The mentioned capillary diameter of from about 0.5 to 1.5 mm is especially suitable for liquid dentifrices which have a viscosity of about 1 and to 5 centipoises, and more particularly of from 1.5 to 2.5 centipoises. It is advantageous to equip the fountain toothbrush with a normal protective cap for the bristle carrier and the bristles. The cap wall can be provided with a clip, by which it can be attached to the rim of a pocket. In order to control the liquid content of the reservoir 2, a window of transparent material, e.g. plexiglass can be provided near the rear end of the handle, or the whole handle can be made of transparent material, i.e., acrylic glass. Of course, bristle carrier 3 and piston 7 need not be made as an integral part (as mentioned before) but may be made separately and joined to another in a known manner by glueing, ultrasonic welding, soldering or by means of a bayonet catch.

In order to facilitate manufacture of the cartridge from thermoplastic resin material by injection molding processes requiring only simple tools, it is preferred to produce the cartridge with an open rear end and then to close the rear opening by means of a lid 30*a* which can be welded thereon to provide a hermetic seal, after the cartridge is filled with dentifrice.

What is claimed is:

1. A fountain toothbrush compsiring:

a bristle carrier;

a set of bristles on said carrier near one end thereof;

a rigid handle connected to said bristle carrier at an end of the latter remote from said bristles, said handle being hollow and having an opening at the rear end thereof away from said bristle carrier;

a rigid-walled reservoir for liquid or pasty dentifrice and being connected to said handle axially displaceable relative thereto, and protruding with its closed rigid rear end from said rear end opening when in rest position, said bristle carrier having a duct therethrough leading from the end of said bristle carrier joined to said handle to an outlet near or between said bristles;

piston means rigidly mounted on said bristle carrier at the end thereof joined to said handle and having an axial bore therein being in free communication with said duct in said bristle carrier and opening out of the rear end of said piston means facing toward said reservoir; and said reservoir having a hollow interior and an outlet passage from said interior at the end thereof toward said bristle carrier, said piston means being sealingly inserted at rest and in actuated position in said outlet passage and adapted for a short displacement in said outlet toward and away from said reservoir, said outlet passage being in free communication with said duct at all times, whereby by a short displacement of said piston in said outlet passage toward said reservoir, dentifrice is caused to flow freely from said reservoir through said duct towards said bristles, said duct having in said bristle carrier, over at least a short length thereof, a diameter small enough to exert a capillary action on the dentifrice in said reservoir, thereby preventing dentifrice from leaking through said outlet passage into said duct, when said piston means are not displaced towards said reservoir; and spring means for returning said reservoir to its rest position relative to said piston after each short displacement of the former toward said bristle carrier.

2. A fountain toothbrush as described in claim 1, further comprising arresting means associated with said reservoir and with said bristle carrier for preventing a complete withdrawal of said piston out of said outlet passage during normal use of the toothbrush.

3. A fountain toothbrush as described in claim 1, wherein said rigid-walled reservoir constitutes an exchangeable cartridge, having pierceable sealing means adapted for being opened when said piston is inserted in said outlet passage.

4. A fountain toothbrush as described in claim 3, wherein said bristle carrier comprises a sleeve portion at the end of said carrier bearing said piston, which sleeve portion is open at its rear end and constitutes said handle.

5. A fountain toothbrush as described in claim 1, wherein said piston comprises a piercing nose surrounding the axial duct of said piston and protruding from the face of the latter turned toward said reservoir, said piercing nose serving for penetrating through said sealing means.

6. A fountain toothbrush as described in claim 5, wherein said portion of said duct exerting said capillary action has a diameter of about 0.5 to 1.5 mm.

7. A fountain toothbrush as described in claim 6, wherein the end faces of said cartridge and of said bristle carrier adjacent one another in the interior of said sleeve portion have cavities, the openings of which register with one another, said return spring means being lodged in said registering recesses.

8. A fountain toothbrush as described in claim 5, wherein the remaining portion of said duct through said bristle carrier has a diameter of about 2 mm.

9. A fountain toothbrush as described in claim 1, wherein said piston bears, on the face thereof inserted in said reservoir, sealing means which engage the interior wall of said reservoir during rest as well as in actuated position.

* * * * *